United States Patent [19]

Campbell

[11] Patent Number: 5,072,918

[45] Date of Patent: Dec. 17, 1991

[54] WORKPIECE CLAMPING DEVICE

[76] Inventor: Norman J. Campbell, High Cayton, South Stainley, Harrogate, Yorks, England

[21] Appl. No.: 355,475

[22] Filed: May 22, 1989

[30] Foreign Application Priority Data

May 26, 1988 [GB] United Kingdom ..... 8812549

[51] Int. Cl.[5] ..... B25H 1/06

[52] U.S. Cl. ..... 269/296; 269/133

[58] Field of Search ..... 269/133, 254 CS, 296, 269/902, 901

[56] References Cited

U.S. PATENT DOCUMENTS

| | | | |
|---|---|---|---|
| 2,709,615 | 5/1955 | Barnes Jr., et al. | 269/133 |
| 3,034,546 | 5/1962 | Parsons | 269/296 |
| 4,566,559 | 1/1986 | van Asten | 269/296 |
| 4,718,652 | 1/1988 | Liebenstein | 269/296 |
| 4,913,412 | 4/1990 | Plouvier | 269/296 |

FOREIGN PATENT DOCUMENTS

| | | | |
|---|---|---|---|
| 1132347 | 3/1957 | France | 269/296 |

*Primary Examiner*—J. J. Hartman

*Attorney, Agent, or Firm*—Needle & Rosenberg

[57] ABSTRACT

Clamping apparatus for holding a workpiece such as a log comprises a cruciform support frame of legs the upper limbs of which define upwardly open V-shape volumes for receiving a log. Arcuately clamped arms are pivotally connected to respective legs and spring biased to a closure position by springs joined by chains to a rigid connector link pivoted to the clamp arm by a pivot projecting onto the opposite side of the clamp arm from the pivotal connection by which it is connected to the leg frame allowing it to be moved to an over-center cocked position in which a curved tail portion projects into the V-shape volume to act as a trigger initiating closure of the clamp arm with the log is placed in position.

In other embodiments a flat working surface replaces the diverging support arms.

12 Claims, 6 Drawing Sheets

WORKPIECE CLAMPING DEVICE

BACKGROUND OF THE INVENTION

The present invention relates generally to a workpiece clamping device, and particularly to a device suitable for holding any form of workpiece in a fixed location to enable working operations to be performed on it.

A major application of the invention relates to the holding of rough felled timber although the invention may find application to other forms of workpiece.

OBJECTS OF THE INVENTION

A primary object of the present invention is to provide apparatus for holding workpieces, especially timber workpieces, offering improvements in relation to means previously employed for holding workpieces.

Another object of the invention is to provide a workpiece holding device capable of quickly engaging or releasing a workpiece to allow it to be held in different positions for a plurality of operations on the workpiece to be performed successively.

In one embodiment which will be described in more detail hereinbelow the invention is formed as a trestle or saw-horse suitable for holding rough felled timber to enable it to be cut into pieces using a chainsaw or other such saw. In this embodiment the apparatus comprises a folding trestle having pivotally interconnected frames adapted to provide, in their working position, an upwardly open V-shape structure into which timber and the like can be lowered for support in a conventional way, and the invention provides means by which such timber can be securely held on the support for working operations to be performed on it. In other embodiments the invention is formed as a workpiece clamping device entirely separate from a support, which may be fitted to a support or to other pieces of apparatus in circumstances where workpiece clamping may be required. For example, a workpiece clamping device of the present invention may be fitted to the end of a ladder to enable the ladder to be securely attached to a branch of a tree so that access to the tree can be gained readily and securely.

It is well known that tree felling and logging operations usually require two operators because a portable chainsaw requires the operator to use both hands to manipulate the saw and he is therefore unable to hold logs, particularly small logs, in a fixed position to enable the chainsaw to be used on them. However, there are many circumstances where an operator is alone and may require to saw one or a number of logs. Although this can sometimes be achieved by placing the operator's foot in a suitable position to restrain the movement of the log, this is both dangerous and inadvisable. The present invention seeks, therefore, among other objectives, to provide a workpiece clamping device which can obviate the necessity for a second operator when using a chainsaw, by providing means by which a workpiece such as a log to be sawn can be held securely in a fixed position allowing the chainsaw operator to work on it whilst nevertheless using both hands for the chainsaw whilst cutting. The present invention finds applications in a wider range than merely as a log saw bench, however, and in general can be characterised as a workpiece clamping device having means by which a workpiece can be readily secured thereto or released therefrom without using screw threaded clamps or vices.

SUMMARY OF THE INVENTION

According to one aspect of the present invention, therefore, a workpiece clamping device comprises support means defining a reaction surface, a clamp arm pivotally mounted on the support means and shaped to engage a workpiece between itself and the reaction surface of the support means when in a workpiece holding position, and resilient biasing means for urging the clamp arm towards the workpiece holding position, when the clamp arm is located between the holding position and a neutral position, and away from the holding position towards a release position when the clamp arm is located on the side of the neutral position remote from the holding position.

Preferably the clamp arm is further provided with trigger means actuable by the workpiece itself or otherwise for causing the clamp arm to move from the release position past the neutral position towards the holding position.

The clamp arm is preferably curved in a plane perpendicular to the pivot axis about which the clamp arm is turnable. This has the beneficial effect that the operating end of the clamp arm can act on the workpiece with a reaction force which is inclined, towards the pivot axis, from that which would be applied by a straight pivoted clamp arm, thereby obviating any tendency of the clamp to exert a component of force away from the pivot which might tend to cause displacement of the workpiece by the ramp effect.

In the preferred embodiment of the invention the clamp arm is pivoted to the support at a point intermediate its ends to define a jaw end of the clamp arm on one side of the pivot and a tail end of the clamp arm on the opposite side of the pivot. The jaw end of the clamp arm may be provided with teeth for engaging a rough sawn log, or with a frictional pad such as a rubber or plastics block for frictionally engaging the workpiece.

The tail end of the clamp arm may be shaped such that it projects from the general plane of the said reaction surface of the support means to which the clamp arm is pivoted when the clamp arm is in the said release position. In such an embodiment the tail of the clamp arm may itself form the said trigger means by causing rotation of the clamp arm away from the release position towards the holding position when contacted by a workpiece causing displacement of the tail portion when positioned against the reaction surface.

The said resilient biasing means may be achieved in any one of a number of ways. In a preferred embodiment of the invention the resilient biasing means comprises a tension spring secured at one end to the support means and attached at the other to a flexible connection member joined in turn to the said clamp arm. The said flexible connection member may be a rope or, and preferably, a chain or any other linear flexible, preferably substantially inextensible member.

In embodiments in which the said flexible member is a chain, the said chain is preferably attached to the said clamp arm by a rigid connector link having a plurality of teeth facing corresponding teeth of the clamp arm when the latter is in the said holding position In such an embodiment the flexible connection member may pass over a guide device which determines the position of the said rigid connector link when the clamp arm is in the said holding position such that the said jaw end of the clamp arm and the said rigid connector link are counterposed when the clamp arm is in the said holding position. The connector link and the clamp arm thus face one another and experience relative approaching movement by approa h of the clamp arm to the holding position thus closing t_ether on the workpiece to retain it in position. Any tendency of the workpiece to rotate between the clamp arm and the reaction surface causes the connector link to grip more firmly and in so doing increase the spring tension to counteract the incipient rotation.

The support means preferably include upwardly divergent members defining a V-shape volume for receiving a workpiece, the said reaction surface facing inwardly of the said volume and the clamp arm being positioned to urge a workpiece in the said V-shape volume towards the narrow end thereof. This embodiment may be constructed as a saw-horse or log bench traditionally having two cruciform frame members defining the V-shape volume within which a log to be sawn is readily held. The said upwardly divergent members of such an embodiment are preferably the upper limbs of respective leg frames pivotally connected together to form such a trestle or saw-horse.

In another embodiment the reaction surface is constituted by a generally planar support table having an opening through which a said clamp arm projects.

The present invention may also be comprehended as apparatus for holding a workpiece comprising a support having upwardly diverging members defining a generally V-shape volume for receiving a workpiece, and a resiliently biased workpiece clamp having a clamp arm pivotally mounted to the support for engaging a workpiece thereon to urge it into the said V-shape volume.

Other features and advantages of the invention will become apparent from a detailed study of the following description in which reference is made to the accompanying drawings.

DESCRIPTION OF THE PREFERRED EMBODIMENTS

Figure 1:
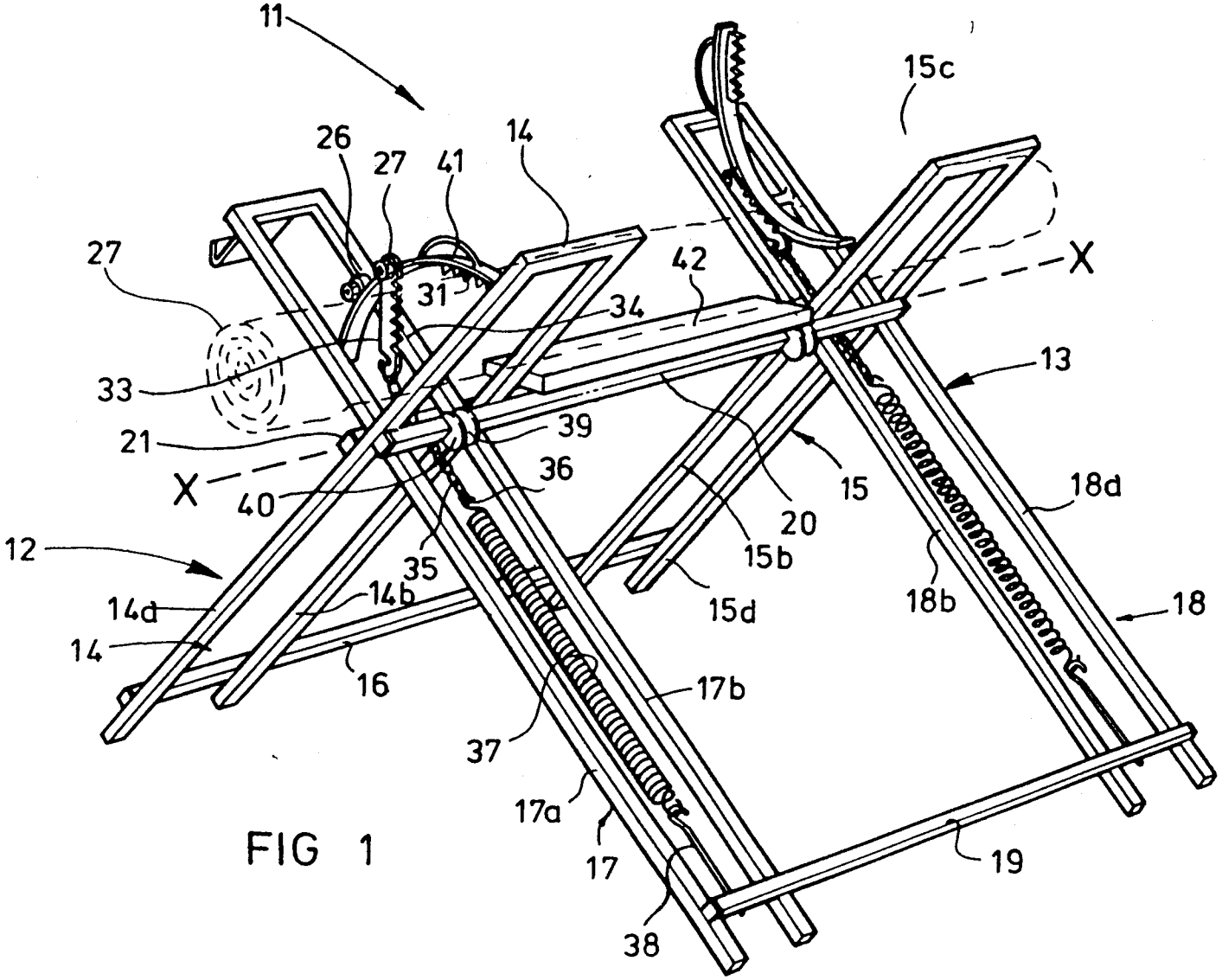
FIG. 1 is a perspective view of a log saw-horse or trestle formed first embodiment of the present invention.
Figure 2:
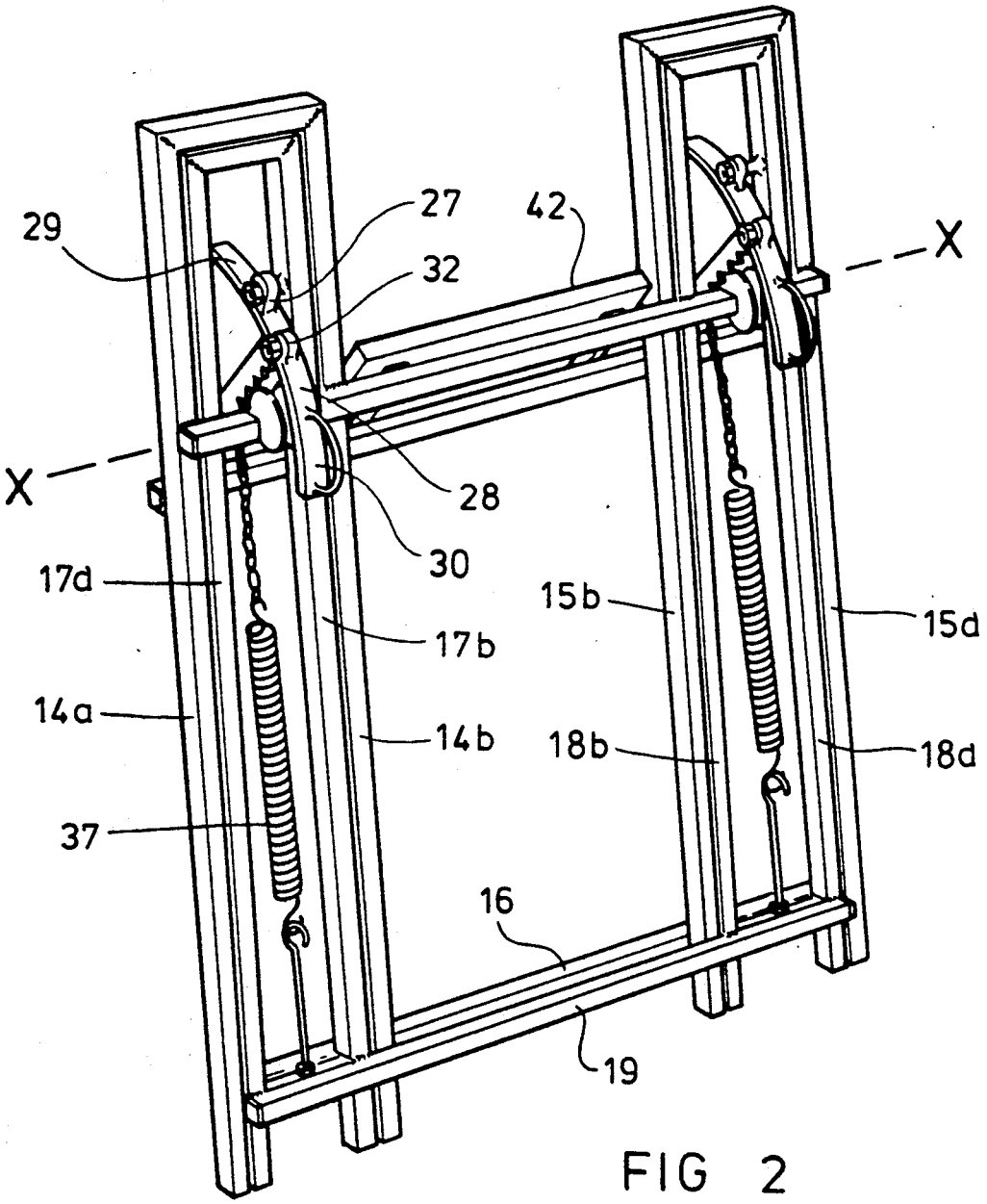
FIG. 2 is a perspective view of the embodiment of FIG. 1 in a collapsed or folded position.

Referring now to the drawings, and particularly to FIGS. 1 and 2 thereof, the first embodiment of the present invention, formed as a saw-horse or trestle, is generally indicated by the reference numeral 11 and constituted by two flat pivoted frames 12, 13 interconnected along a pivot axis X—X. The frame 12 comprises two generally rectangular leg frames 14, 15 joined at their lower ends by a horizontal rail 16. Each of the leg frames 14, 15 is composed of respective parallel legs 14*a*, 14*b* and 15*a*, 15*b* joined at their upper ends by horizontal struts 14*c*, 15*c*. The main frame 13 is, likewise, composed of two inverted U-shape leg frames 17, 18, each composed of two parallel legs 17*a*, 17*b* and 18*a*, 18*b* joined by a bight limb or strut 17*c*, 18*c* and the lower ends of the inverted U-shape leg frames 17, 18 are joined by a horizontal rail 19.

The two leg frames 14, 15 are also joined together, in the region of the pivot axis X—X, by two upper horizontal rails 20, 21 the first of which is secured, such as by welding, to the underside of the leg frames 14, 15 and the other of which is secured, at a position slightly displaced along the length of the frames 14, 15 to the other side thereof.

The leg 17*b* is pivotally connected to the leg 14*b* and the leg 18*b* is pivotally connected to the leg 15*b* so that the two frames 12, 13 turn about the axis X—X from the erected position shown in FIG. 1 to the collapsed position shown in FIG. 2, in which position the inverted U-shape sub frames 17, 18 of the side frame 13 lie within the outlines of the inverted U-shape sub frames 14, 15. In the erected position shown in FIG. 1 the sub frames 17, 18 come into contact with the upper transverse struts 20, 21 to define the limit of turning movement, whilst in the collapsed position illustrated in FIG. 2 the sub frames 17, 18 contact the lower struts 16 and the sub frames 14, 15 contact the transverse strut 19.

As will be seen from FIG. 1, therefore, in the erected position the two inverted U-shape sub frames 14, 17 and the two inverted U-shape sub frames 15, 18 form respective pairs of cruciform legs the upper limbs of which, that is the part of each sub frame above the pivot line X—X form upwardly open diverging volumes for receiving a workpiece such as the log indicated in broken outline and identified by the reference numeral 25. In order to retain the log 25 in position the apparatus is provided with two workpiece holding clamps which are identical to one another and therefore only one of which will be described hereinbelow, namely that attached to the inverted U-shape leg frame 17. As will be seen in FIG. 1 and FIG. 2, the leg 17*b* has, near its upper end, a boss 26 from which projects a pivot pin on which is pivoted a lug 27 welded to an arcuately curved clamp arm 28 which is separated into two portions by the lug 27, namely a tail portion 29 on one side of the lug and a jaw portion 30 on the end remote from the tail portion 29. The jaw portion 30 of the clamp arm 28 is provided with a serrated plate 31 forming a plurality of teeth.

The arcuate clamp arm 28 is also provided with a second lug 32 to which is pivoted a rigid connector link 33 by a pivot which extends to the opposite side of the clamp arm 28 from that to which the pivot pin passing through the lug 27 extends. Thus, as the clamp arm 28 is turned about the pivot 26 no interference between the two pivots 26 and 32 is experienced. The rigid connector link 33 is itself provided with a set of serrations 34 facing the serrations of the plate 31 to form a counterposed jaw. The rigid link 33 is also connected to one end of a chain 35 which is guided between the two upper transverse struts 20, 21 and is joined at its lower end to the upper end 36 of a tension spring 37 the other end of which is joined to a tensioner 38 connected to the lower transverse rail 19. Tension in the spring 37 thus draws the chain 35 through the space between the two transverse struts 20, 21 pulling the rigid connector link 33 downwards and thus urging the clamp arm 28 to turn in a clockwise sense as viewed in FIGS. 1 and 2 to bring the serrated plate 31 into contact with two abutment stops 39, 40 which are welded to the upper transverse strut 20.

Finally, the arcuate clamp arm 28 is provided with a handle loop 41 by which it can be turned manually about the pivot 26 and the two upper transverse struts 20, 21 are provided with a platform member 42 conveniently of wood or plastics.

As described hereinabove the apparatus of the present invention can be made entirely of metal, apart from the platform member 42 for strength and durability although some components may be replaced with plastics should this be found desirable.

In use of the apparatus described hereinabove the two main frames 12, 13 are turned about the pivot axis X—X to erect the apparatus to the position shown in FIG. 1. Then, by grasping the handle 41 of the clamp arm 28 this latter can be turned about the pivot 26 until the boss 32 to which the rigid connector link 33 is connected passes between the two legs 17*a*, 17*b*, in which position the line of action of the tension applied by the spring 37 via the chain 35 tends to turn the clamp arm 28 in an anti-clockwise rather than a clockwise sense due to the fact that the boss 32 is now on the opposite side of the pivot 26 from that shown in FIGS. 1 and 2 (here reference may be made to the clamp arm 28 attached to the leg frame 18*a* which is shown in its open position). As will be seen, in this position the tail portion 29 of the clamp arm 28 projects into the V-shape volume defined by the upper limbs of the legs constituting the cruciform frame member. The dimensions of these components are so chosen that when a log 25 is placed between the upper limbs of the cruciform leg frames it depresses this to a point where the boss 32 is moved back past the pivot 27 so that the spring 37 then urges the clamp arm 28 in a clockwise direction to bring the serrated jaw 31 into contact with the log 25 to hold it securely in position. In this position the tension applied by the spring 37 also urges the rigid link 33 towards the log 25, in an attempt to straighten the chain 35 thereby reinforcing the holding effect. Working operations, such as sawing on the log 25, can then be performed single handedly without risk of movement of the log 25 during these operations.

Figure 3:
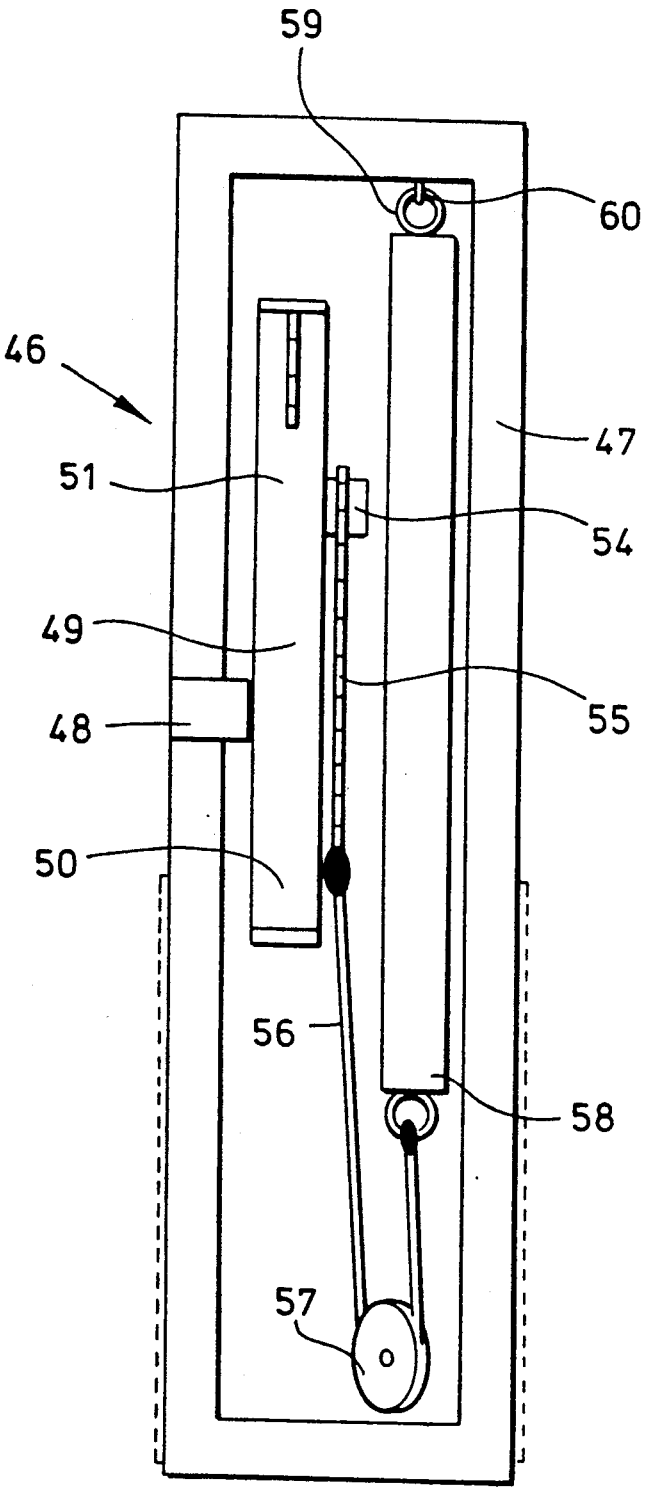
FIG. 3 is a face view of a workpiece clamping device formed as an alternative embodiment of the present invention.
Figure 4:
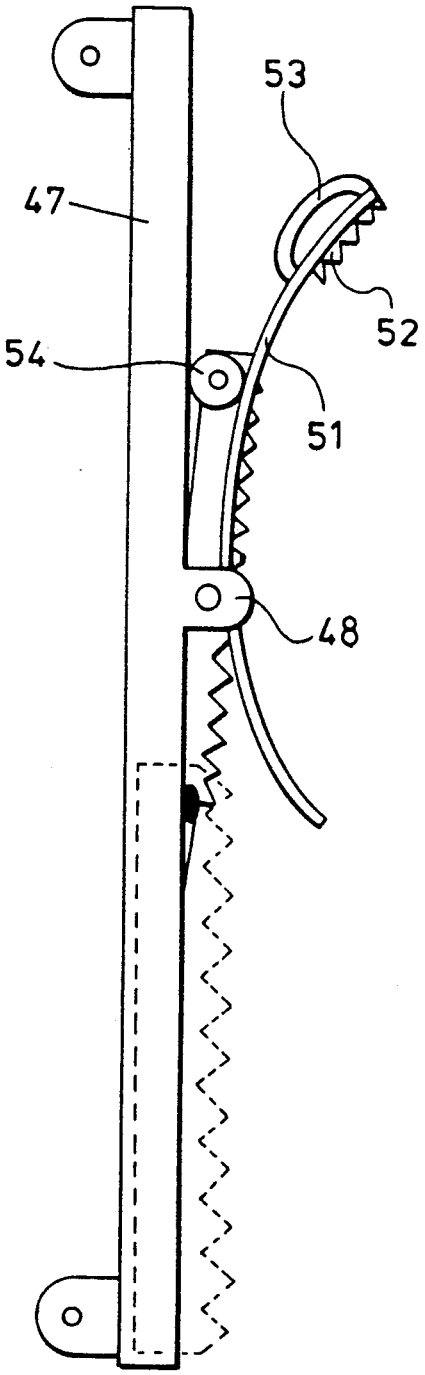
FIG. 4 is a side view of the embodiment of FIG. 3.
Figure 5:
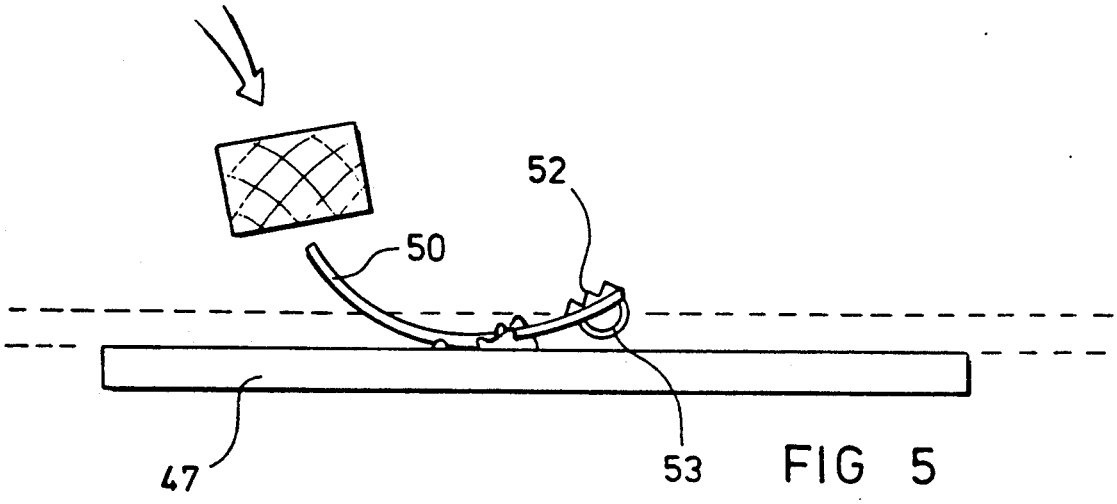
FIGS. 5 and 6 are schematic side views of the embodiment of FIGS. 3 and 4 showing two different working positions.
Figure 6:
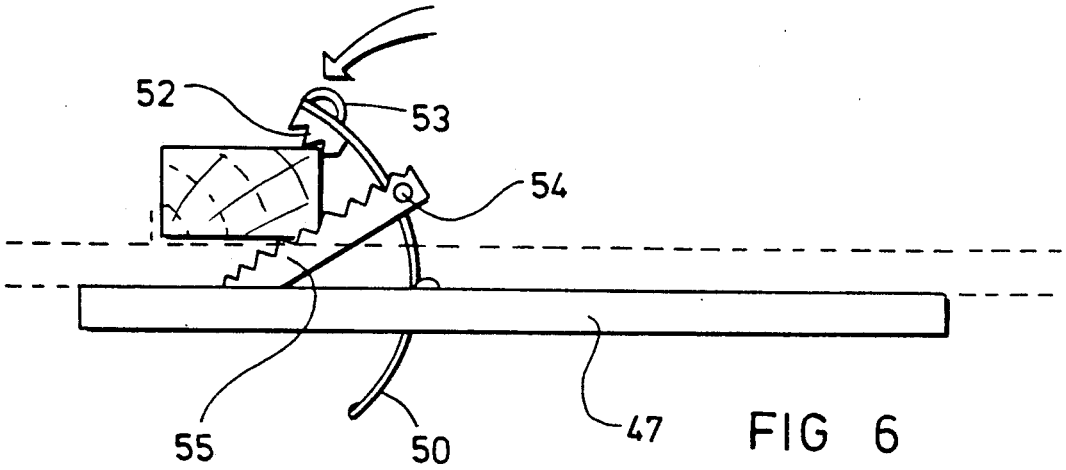

Referring now to FIGS. 3 to 6 an embodiment of the clamping device separate from a saw-horse is illustrated. The clamping device illustrated in FIG. 3 is generally indicated with the reference numeral 46 and comprises a rectangular frame 47 having a first boss 48 constituting a pivotal connection for an arcuately curved clamp arm 49 having a tail portion 50 and a jaw portion 51 which, as in the embodiment of FIGS. 1 and 2, is provided with a serrated jaw plate 52 and a loop handle 53. An offset boss 54 pivotally connects the clamp arm 49 to a serrated rigid link 55 which is connected to a cord 56 passing over a pulley 57 and joined at its other end to one end of a tension spring 58 the other end of which is connected by a loop 59 to a hook 60 attached to the rigid frame 47. FIG. 5 illustrates the clamping device in its set or cocked position ready to receive a workpiece, and FIG. 6 illustrates the clamping device after having been triggered when it is drawn to a holding position by the spring.

Figure 7:
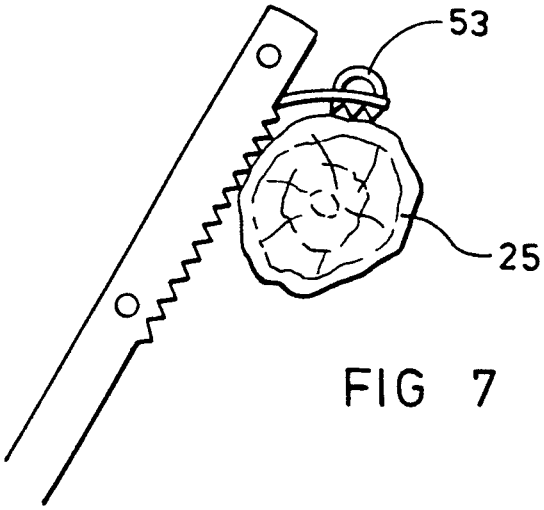
FIG. 7 is a side view of a third embodiment of the invention.
Figure 8:
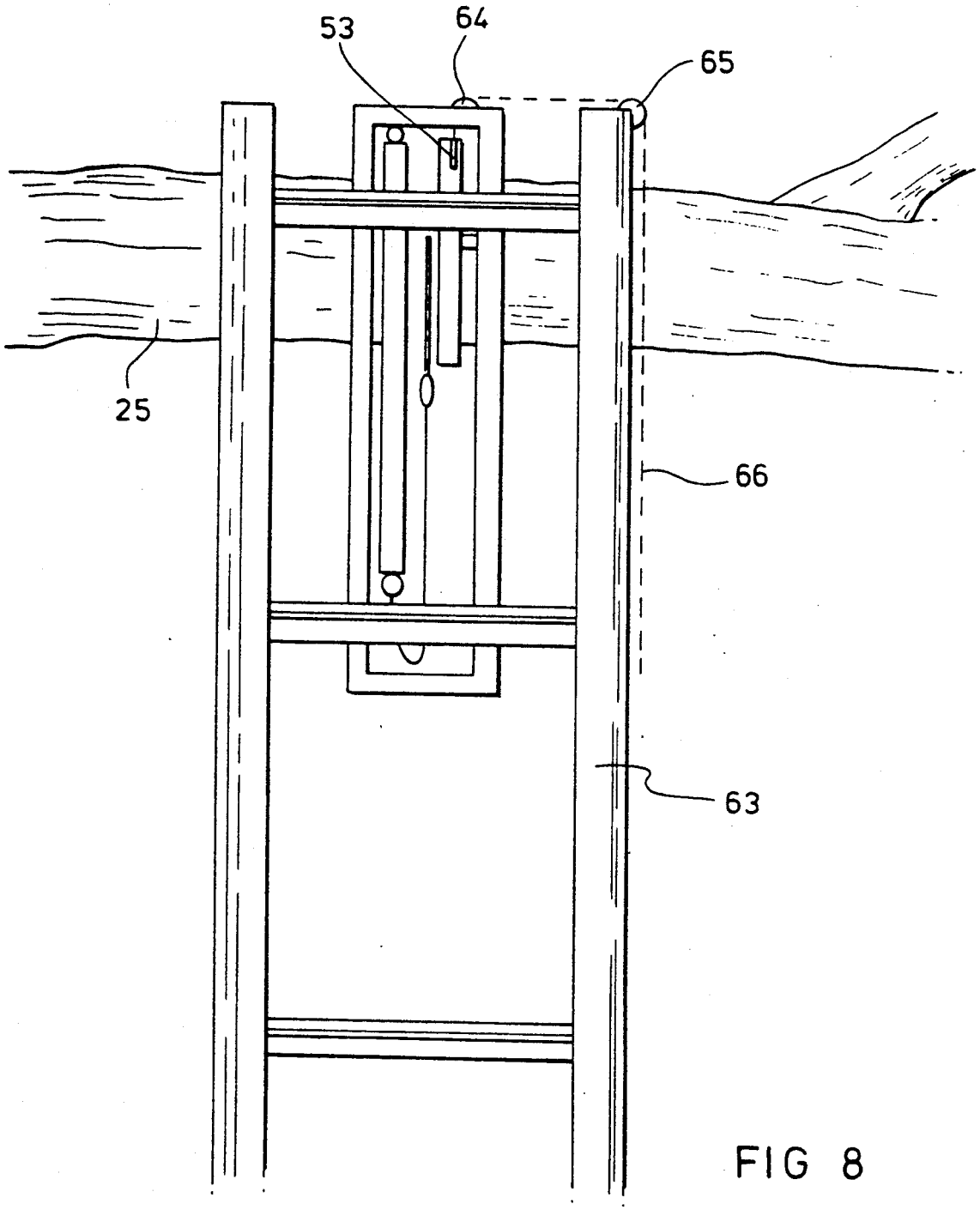
FIG. 8 is a schematic view of a further embodiment of the present invention shown in position on a ladder.

FIGS. 7 and 8 illustrate the holding device of FIGS. 3 to 4 fitted to a ladder 63, and differs from the embodiment of FIGS. 3 and 4 only in the provision of two pulleys 64, 65 and a release line 66 connected to the handle loop 53 to allow the release and cocking of the jaw. In these Figures the clamp arm is biased to clamp onto, for example, a branch, from above. It is also possible to mount the clamp inverted, however, so that the clamp arm acts from below. This simplifies the release mechanism since the arm can be directly connected to the release line 66 without the need for the pulleys 64, 65.

Figure 9:
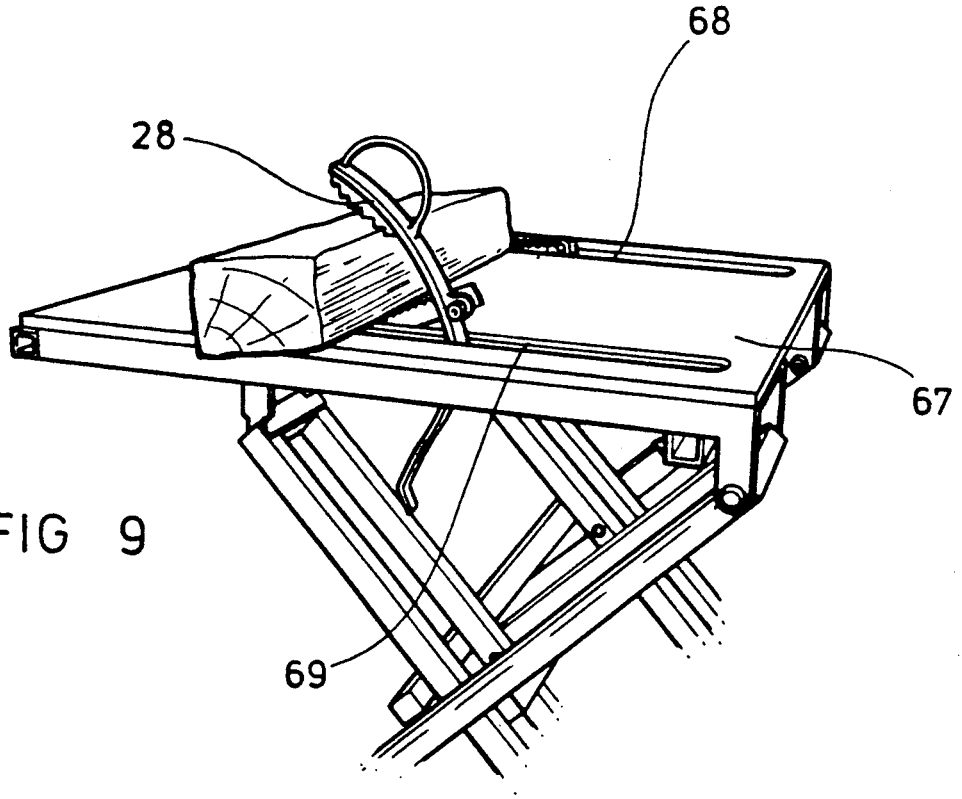
FIG. 9 a perspective view of a further embodiment of the present invention formed as a workbench.
Figure 10:
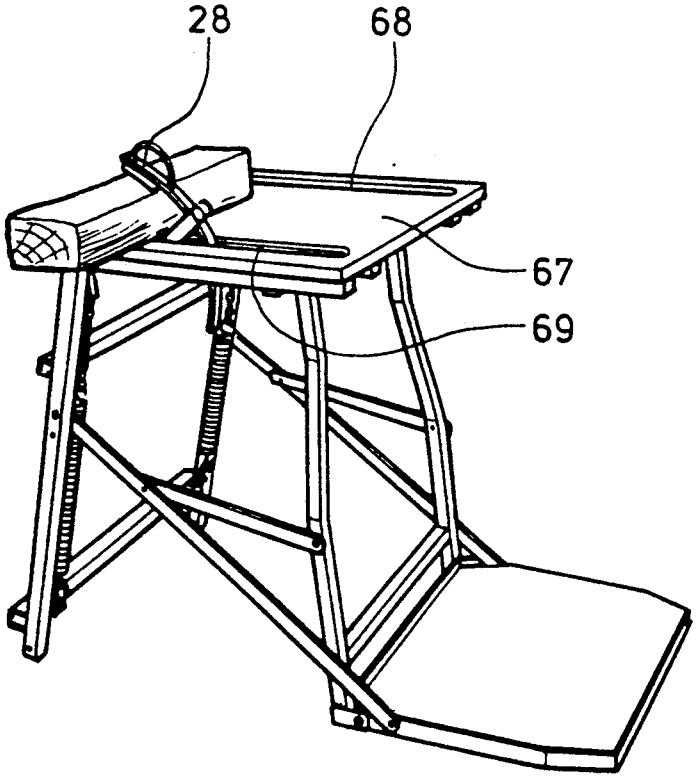
FIG. 10 is a perspective view of an alternative workbench embodiment.

Finally, FIGS. 9 and 10 show an embodiment in which the clamping members are fitted to the underside of a workbench having a substantially flat working surface 67 with two slots 68, 69 through which the clamp arms 28 can project. In the embodiment of FIG. 9 the supporting framework is constituted by the cruciform structure of the embodiment of FIG. 1, whilst in the embodiment of FIG. 10 an alternative folding structure is illustrated.

As will be appreciated, in the embodiments illustrated, the closure of the jaws upon triggering by displacement of the tail portion 29 of the clamp arm 28 takes place immediately the relative positions of the pivot 26 and the boss 27 are such that the spring 37 can apply the appropriate turning moment to the clamp arm 28. In other embodiments (not shown) this motion is delayed or slowed by the introduction of a damper, for example in the path of the chain 35, so that closing motion of the jaw 31 of the clamp arm 28 does not take place too rapidly.

I claim:

1. A workpiece clamping device comprising:

support means defining a reaction surface, a clamp arm, means pivotally mounting said clamp arm on said support means for turning movement between a workpiece holding position in which it clamps a workpiece between itself and said reaction surface and a release position in which said workpiece can be placed on or removed from said reaction surface and, resilient biasing means urging said clamp arm to turn about said pivotal mounting means towards said workpiece holding position when said clamp arm is located between said holding position and a neutral position and to turn said clamp arm away from said holding position towards said release position when said clamp arm is located on the side of said neutral position remote from said holding position, and trigger means engageable by said workpiece itself on approach to said reaction surface whereby to cause said clamp arm to move from said release position past said neutral position towards said holding position.

2. The workpiece clamping device of claim 1 wherein said tail end of the clamp arm projects from said reaction surface of the support means to which the clamp arm is pivoted when the clamp arm is in the release position and forms the said trigger means.

3. The workpiece clamping device of claim 1, wherein said resilient biasing means comprises a tension spring secured at one end to the support means and attached at the other to a flexible connection member joined in turn to the said clamp arm.

4. The workpiece clamping device of claim 3, wherein said flexible connection member is a chain.

5. The workpiece clamping device of claim 1, wherein said support means include upwardly divergent members defining a V-shape volume for receiving a workpiece, the said reaction surface facing inwardly of the said volume and the clamp arm being positioned to urge a workpiece in the said V-shape volume towards the narrow end thereof.

6. The workpiece clamping device of claim 5, wherein said upwardly divergent members are the upper limbs of respective leg frames pivotally connected together to form a trestle.

7. The workpiece clamping device of claim 1, wherein said support means comprise a pair of upwardly diverging members defining a generally V-shape volume for receiving said workpiece, and said clamp arm is pivotally mounted on one of said members for engaging a workpiece and urging it into said V-Shape volume.

8. The workpiece clamping device of claim 1, wherein said pivotal mounting means define a pivot axis about which said clamp arm is turnable and said clamp arm is curved in a plane perpendicular to said pivot axis.

9. The workpiece clamping device of claim 1, wherein said pivotal mounting means mount said clamp arm on said support at a point intermediate the ends of said clamp arm to define a jaw end of the clamp arm on one side of said pivotal mounting means and a tail end of the clamp arm on the opposite side of said pivotal mounting means.

10. A workpiece clamping device comprising:

support means defining a reaction surface, a clamp arm, means pivotally mounting said clamp arm on said support means, said clamp arm being shaped to engage a workpiece between itself and said reaction surface of said support means when in a workpiece holding position, resilient biasing means urging said clamp arm to turn about said pivotal mounting means towards said workpiece holding position when said clamp arm is located between said holding position and a neutral position and away from said holding position towards a release position when said clamp arm is located on the side of said neutral position remote from said holding position, trigger means engageable by said workpiece itself on approach to said reaction surface whereby to cause said clamp arm to move from said release position past said neutral position towards said holding position, and wherein said resilient biasing means comprise a tension spring secured at one end to said support means, said clamp arm has a plurality of teeth and a rigid connection link also having a plurality of teeth facing said teeth of the clamp arm when the latter is in said holding position, a chain is connected to said rigid connecting link, and said tension spring is secured at its end opposite said one end to said chain.

11. The workpiece clamping device of claim 10, wherein said flexible connection member passes over a guide device which determines the position of the said rigid connector link when the clamp arm is in the said holding position such that the said jaw end of the clamp arm and the said rigid connector link are counterposed when the clamp arm is in the said holding position.

12. The workpiece clamping device of claim 11, wherein said guide device is a pulley over which the flexible connection member passes.

* * * * *